United States Patent [19]

Karassik

[11] Patent Number: 4,740,137

[45] Date of Patent: Apr. 26, 1988

[54] METHOD AND APPARATUS FOR IMPROVING THE EFFICIENCY OF CENTRIFUGAL PUMPS

[75] Inventor: Igor J. Karassik, Maplewood, N.J.

[73] Assignee: Dresser Industries, Inc., Dallas, Tex.

[21] Appl. No.: 931,386

[22] Filed: Nov. 17, 1986

[51] Int. Cl.[4] ..... F04D 1/06

[52] U.S. Cl. ..... 415/11; 415/53 R; 415/27

[58] Field of Search ..... 415/53 R, 11, 51, 28, 415/27

[56] References Cited

U.S. PATENT DOCUMENTS

| | | | |
|---|---|---|---|
| 1,796,053 | 3/1931 | Schmidt . | |
| 2,086,806 | 7/1937 | Hollander | 103/102 |
| 3,168,870 | 2/1965 | Hornschuch | 103/97 |
| 4,149,825 | 4/1979 | Grennan | 415/11 |

*Primary Examiner*—Larry I. Schwartz

*Attorney, Agent, or Firm*—Kanz, Scherback Timmons

[57] ABSTRACT

The pump system provides for a more efficient operation of multistage centrifugal pumps operating at less than designed capacity. The system includes a flow meter located in the inlet conduit to the pump, a control valve is located in a discharge conduit that extends from the discharge of the first stage of the pump to the inlet conduit, and a connection between the flow meter and control valve whereby the control valve will open to bypass liquid from the first stage discharge to assure that flow through the first stage is greater than the value wherein the internal recirculation occurs. Thus, the pump is capable of circulating a substantially greater amount of liquid through the first stage of the pump when the demand volume at the pump discharge is substantially less than the design value.

6 Claims, 1 Drawing Sheet

METHOD AND APPARATUS FOR IMPROVING THE EFFICIENCY OF CENTRIFUGAL PUMPS

BACKGROUND OF THE INVENTION

This invention relates generally to improved centrifugal pumps. More particularly, but not by way of limitation, this invention relates to method and apparatus for increasing the efficiency of centrifugal pumps when used at less than design capacity.

In multistage centrifugal pumps, pumping less than the capacity of liquid therethrough may result in internal recirculation within the pump which substantially lowers the efficiency of the pump and may, in some instances, be so severe as to cause damage or destruction to the pump. It has been found that such internal recirculation is predominant in the first stage of multistage pumps.

In the past, when pumps were to be used to deliver less liquid than their design capacity, great care has been taken to make certain that adequate liquid has been pumped thereby to maintain the throughput of the pump above the design value of the internal recirculation problem. To accomplish this, multistage centrifugal pumps in the past have had a bypass arrangement at the discharge permitting fluid in excess of the demand value to either be recirculated to the pump inlet or disposed of in some other means. In any event, the energy lost by having to pump the entire quantity through the entire pump before bypassing has had a severe effect on the efficiency of multistage centrifugal pumps when operating at less than design capacity.

In the applications of multistage centrifugal pumps such as when used as boiler feed pumps, it is necessary that the pumps be designed to handle the maximum volume of liquid that may be required by the system operating at peak load. Accordingly, such pumps will frequently be operated at less than capacity when the demand is not at the peak load.

An object of this invention is to provide improved methods and apparatus for increasing the efficiency of multistage centrifugal pumps when they are operating at less than the design capacity.

SUMMARY OF THE INVENTION

In one aspect, this invention contemplates a pump system that provides efficient use of a centrifugal pump at less than the design capacity wherein the system comprises: centrifugal pump having a plurality of stages; driving means connected with the pump for causing the pump to deliver a volume of liquid equal to the design value wherein internal recirculation of liquid ceases in the first stage of the pump; a meter located in the inlet for measuring the quantity of liquid entering the first stage of the pump and transmitting signals indicating of such quantity; and, a control valve located between an outlet from the first stage and the pump inlet upstream of the meter. The control valve is responsive to signals from the meter to open and permit liquid flow from the first stage to the pump inlet whereby the quantity of liquid flowing through the first stage in excess of the system requirement downstream of the first stage is bypassed through the conduit means to the pump inlet to maintain the liquid flow through the first stage at above the value at which internal recirculation occurs.

The invention further contemplates a method for improving the efficiency of a multistage centrifugal pump that is used to deliver a quantity of liquid below the design capacity of the pump. The method comprises the steps of driving the pump to supply liquid in excess of that required downstream of the pump and at least equal to the quantity required to prevent internal recirculation in the pump; and, withdrawing liquid from an outlet of the first stage of the pump in excess of that required downstream of the pump whereby only the quantity required downstream of the pump is delivered to the remaining pump stages.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
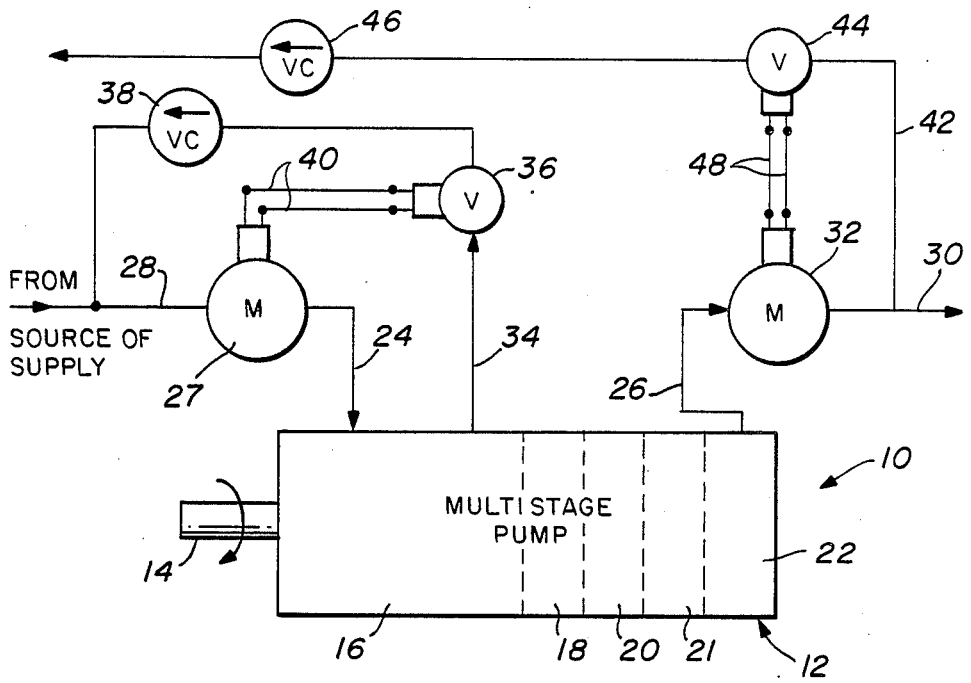
FIG. 1 is a schematic view illustrating a multistage pump system that is constructed in accordance with the invention.

Referring to the drawing and to FIG. 1 in particular, shown therein and generally designated by the reference character 10, is a pump system that is constructed in accordance with the invention. The pump system 10 includes a multistage centrifugal pump 12 driven through a shaft 14 by a motor or other suitable driver (not shown). The multistage pump 12 includes a first stage 16, second stage 18, third stage 20, fourth stage 21, and fifth stage 22. While described as including five stages, the pump 12 could include as many stages as necessary to provide the system with the desired throughput of liquid.

A pump inlet 24 is connected to the first stage 16 and a pump outlet 26 is connected with the last stage 22. A liquid flow meter 27 is disposed in an inlet conduit 28 that is connected with the pump inlet 24. It will be understood that the inlet conduit 28 is connected with a source of liquid (not shown). The pump outlet 26 is connected with a conduit 30 which is connected by the necessary valve, fittings, etc. (not shown) with the ultimate user of the liquid being pumped by the system 10. A second flow meter 32 is shown as being located in the conduit 30.

One end of the first stage outlet conduit 34 is connected to the first stage 16. It will be understood, of course, that the stages 16, 18, 20, 21, and 22 are connected internally in the usual manner to provide for the flow of liquid sequentially therebetween.

The opposite end of the outlet conduit 34 is connected to the inlet conduit 28. The conduit 34 has a control valve 36 and a check valve 38 located therein. The valve 38 permits flow through the conduit 34 only in the direction indicated by the arrow.

The control valve 36 is interconnected by the conductors 40 with the flow meter 27 which is located in the inlet conduit 28. The control valve 36 may be either an "on-off" vlave or may be a modulating valve as desired, but it is responsive to signals generated by the flow meter 27 as liquid flows through the conduit 28.

The conduit 30 is also connected with a bypass conduit 42 that connects with the source of supply to the pump from which conduit 28 brings the liquid to the inlet 24.

The conduit 42 is also provided with a control valve 44 and with a check valve 46. The control valve 44 is also of the "on-off" or modulating type as desired. The valve 44 is electrically connected by conductors 48 with the flow meter 32.

OPERATION OF THE PREFERRED EMBODIMENT

In operation, the motor or other driver connected to the shaft 14 rotates causing the pump impeller or rotor (not shown) to rotate, moving liquid from the inlet conduit 28 through the inlet 24 into the first stage 16 of the pump 12. As previously mentioned, if the flow through a multistage centrifugal pump such as the pump 12 is below the design capacity, there is a certain value, that is, flow volume of liquid, below which internal recirculation occurs in the pump 12.

The internal recirculation problem occurs primarily in the first stage 16. Accordingly, if the demand at the outlet conduit 30 from the pump 12 is lower than the value at which internal recirculation occurs, liquid volume greater than the demand volume and at least equal to the recirculation onset value must be passed through the multistage pump and then a portion of the liquid in excess of the demand volume bypassed.

The flow conditions may best by understood by use of example. Therefore, assume that the design capacity of the pump is 6,000 gallons per minute. Also, assume that the value at which internal recirculation occurs in the first stage 16 is 4,200 gallons per minute, assume that 1,750 gallons per minute must be passed through the entire pump in order to avoid heating problems, and assume that the demand at the outlet conduit 30 is 1,000 gallons per minute. Thus, it will be appreciated that the demand of 1,000 gallons per minute is substantially below the design capacity of 6,000 gallons per minute of the pump and below the value of 4,200 gallons per minute where internal recirculation occurs and below the 1,750 gallons per minute where heating may occur.

With the shaft 14 rotating at such speed as to move at least 4,200 gallons per minute through the first stage 16 and only 1,000 gallons per minute being supplied at the outlet, the amount of liquid passing through the inlet conduit 28 and flow meter 26 will be 1,000 gallons per minute. The flow meter 27 transmits a signal to the control valve 36 indicating that an insufficient amount of liquid is flowing to the first stage 16 to prevent internal recirculation. Upon reaching the valve 36, the signal causes the valve 36 to open and liquid flows from the first stage outlet 34 into the inlet conduit 28 through the check valve 38. The valve 36 remains open until the flow meter 26 indicates that at least 4,200 gallons per minute are flowing through the inlet conduit 28 into the inlet 24 of the first stage 16.

As previously mentioned, 1,750 gallons per minute are required to prevent heating in the pump 12. Therefore, flow internally from the first stage 16 to the second stage 18 should be at least 1,750 gallons per minute. The amount of fluid bypassed through the first stage outlet conduit 34 will be 4,200 minus 1,750 or 2,450 gallons per minute.

Since the demand load is only 1,000 gallons per minute, the flow meter 32 in the outlet conduit 30 transmits a signal to the control valve 44 located in the bypass conduit 42 causing the vlave 44 to open and bypass 750 gallons per minute of the 1,750 gallons per minute through the conduit 42 to a heat exchanger or the like (not shown) wherein the heat can be dissipated. Thus, it will be seen that the power required to drive the pump 12 is that necessary to provide 4,200 gallons per minute in the first stage 16 and 1,750 gallons per minute through the stages 18, 20, 21 and 22. In the past, the power required would have been that power necessary to pump 4,200 gallons through all stages of the pump.

Figure 2:
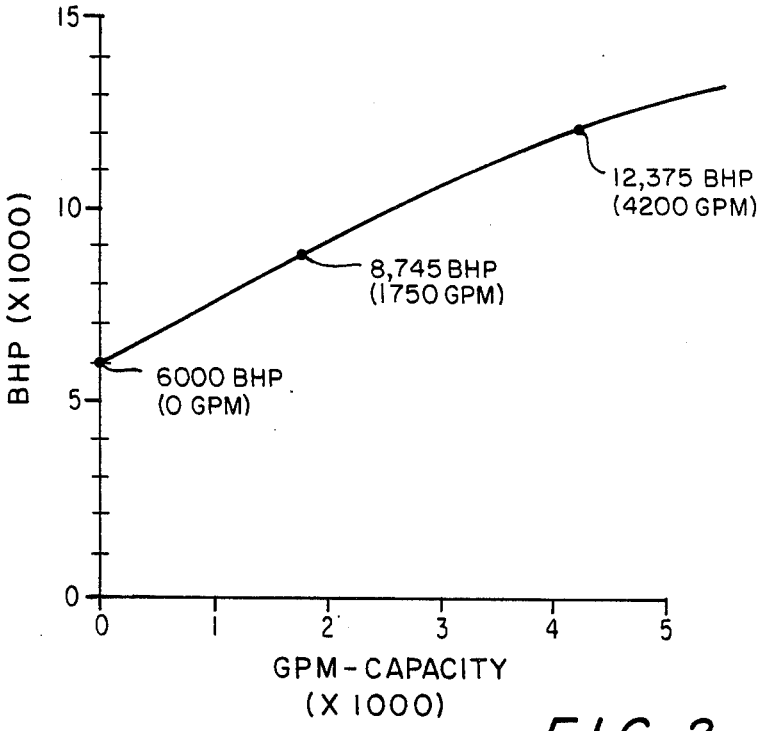
FIG. 2 is a typical brake horsepower curve from a multistage centrifugal pump such as that illustrated in FIG. 1.

Referring to FIG. 2, it can be seen that at 4,200 gallons per minute, the brake horsepower required in the pump 12 is 12,375. For only the thermally required flow, that is for 1,750 gallons per minute, the brake horsepower requirement is 8,745. Thus, it requires 3,630 more brake horsepower because of the internal recirculation problem than is necessary to protect the pump against an excessive temperature rise.

In the five stage pump 12, the first stage horsepower requirement for the 4,200 gallons per minute is equal to one-fifth of 12,375 or 2,475 horsepower and that the last four stages horsepower requirement for the 1,750 gallons per minute equals four-fifths of 8,745 horsepower or 6,996 horsepower. The total horsepower requirement through the pump 12 is 9,471. This is to be compared to a total horsepower requirement, of 12,375 where 4,200 gallons per minute is passed through the entire pump 12. Thus, a saving of 2,904 horsepower, the difference between 12,375 and 9,471 horsepower, is realized by using the system 10.

To evaluate the dollar savings derived from the system 10, it is necessary to determine the number of hours per year the pump 12 will be operating in the mode described and multiply that times the cost per horsepower hour over the projected life of the pumping system 10. A substantial energy saving and pump efficiency results from the use of the system 10.

The pump system described in detail hereinbefore is presented by way of example only and many changes can be made thereto without departing from the spirit or scope of the invention.

What is claimed is:

1. A pump system providing efficient use of a centrifugal pump at less than design capacity, the system comprising:

a multistage centrifugal pump having an inlet and an outlet; and, means for measuring the quantity of liquid entering the first stage of said pump and for bypassing liquid from said first stage that exceeds the requirement downstream of said first stage to maintain the liquid flow through said first stage above the value where internal recirculation occurs.

2. The pump system of claim 1 wherein said means includes:

a meter located for measuring flow in said pump inlet and generating a signal indicative of such flow; and, a valve operably connected to an outlet from said first stage, said valve being responsive to said signals to control flow from said first stage outlet to said pump inlet.

3. A pump system providing efficient use of a centrifugal pump at less than design capacity, the system comprising:

a centrifugal pump having a pump inlet, a pump outlet, and a plurality of stages;

driving means connected with said pump for causing said pump to deliver a volume of liquid equal to the value wherein internal recirculation of liquid ceases in the first stage of the pump;

a meter located in said pump inlet for measuring the quantity of liquid entering the first stage of said pump and transmitting signals indicative of such quantity; and, a control valve located in conduit means between an outlet from said first stage and said pump inlet upstream of said meter, said control valve being responsive to said signals to open and permit liquid flow from said first stage to said pump inlet whereby the quantity of liquid flowing through the first stage in excess of the system requirement downstream of the first stage is bypassed through said conduit means to said pump inlet to maintain the liquid flow through said first stage above the value where internal recirculation occurs.

4. A method for improving the efficiency of a multi-stage centrifugal pump when used to deliver a quantity of liquid below the design capacity of the pump, the method comprising the steps of:

supplying the pump with liquid in excess of that required downstream of the pump and at least equal to the quantity required to prevent internal recirculation in the pump; and, withdrawing liquid from an outlet of the first stage of the pump in excess of that required downstream of the pump whereby the quantity required downstream of the pump is delivered to the remaining pump stages.

5. The method of claim 4 and also including the step of recirculating the withdrawn liquid to the pump inlet.

6. A method for improving the efficiency of a multi-stage centrifugal pump when used to deliver a quantity of liquid below the design capacity of said pump, the method comprising the steps of:

supplying the first stage of said pump with liquid in excess of that required to prevent internal recirculation in the first stage and in excess of that required at the pump outlet;

measuring the quantity of liquid flowing to the first stage of said pump;

transmitting a signal indicative of said quantity to a control valve located in an outlet from said first stage; and, actuating said valve in response to said signal to bypass liquid to said inlet when the quantity of liquid supplied to said first stage is in excess of that required at the pump outlet to maintain the volume of liquid in the pump first stage to prevent internal recirculation in said first stage.

* * * * *